US010277979B2

(12) United States Patent
Naderyan et al.

(10) Patent No.: US 10,277,979 B2
(45) Date of Patent: Apr. 30, 2019

(54) REDUCED-DAMPING ACOUSTIC HOLES

(71) Applicant: Knowles Electronics, LLC, Itasca, IL (US)

(72) Inventors: Vahid Naderyan, Itasca, IL (US); Wade Conklin, Chicago, IL (US); Michael Kuntzman, Chicago, IL (US); Sung Lee, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/159,693

(22) Filed: May 19, 2016

(65) Prior Publication Data

US 2017/0339485 A1 Nov. 23, 2017

(51) Int. Cl.
*H04R 1/28* (2006.01)
*H04R 23/00* (2006.01)
(Continued)

(52) U.S. Cl.
CPC ..... *H04R 1/2876* (2013.01); *H04R 19/005* (2013.01); *H04R 23/00* (2013.01);
(Continued)

(58) Field of Classification Search
CPC .. H04R 1/2876; H04R 1/2807; H04R 1/2846; H04R 1/2823; H04R 23/00; H04R 9/00;
(Continued)

(56) References Cited

U.S. PATENT DOCUMENTS 6,583,548 B2 * 6/2003 Cho ..... H01J 29/503 313/409
2009/0200637 A1 * 8/2009 Williams ..... H01L 28/91 257/532
(Continued)

FOREIGN PATENT DOCUMENTS

DE 10 2006 002 106 B4 3/2016

OTHER PUBLICATIONS

Iguchi et al., Silicon Mirophone with Wide Frequency Range and High Linearity, Aug. 22, 2006, pp. 420-425.*
(Continued)

*Primary Examiner* — Fan S Tsang
*Assistant Examiner* — Angelica M McKinney
(74) *Attorney, Agent, or Firm* — Foley & Lardner LLP

(57) ABSTRACT

Systems and apparatuses for a MEMS device. The MEMS device includes a diaphragm and a backplate spaced a distance from the diaphragm forming an air gap therebetween. The backplate includes a first surface facing toward the diaphragm and an opposing second surface facing away from the diaphragm. The first surface and the opposing second surface of the backplate cooperatively define a plurality of through-holes that extend through the backplate allowing air from the air gap to flow therethrough. Each of the plurality of through-holes include a first aperture disposed along the first surface, a second aperture disposed along the opposing second surface, and a sidewall extending between the first surface and the opposing second surface.
(Continued)

The first aperture and the second aperture have different dimensions.

15 Claims, 5 Drawing Sheets

(51) Int. Cl.
*H04R 19/00* (2006.01)
*H04R 1/22* (2006.01)
*H04R 19/04* (2006.01)

(52) U.S. Cl.
CPC ..... *H04R 1/222* (2013.01); *H04R 19/04* (2013.01); *H04R 2201/003* (2013.01); *H04R 2499/11* (2013.01); *H04R 2499/15* (2013.01)

(58) Field of Classification Search
CPC ..... H04R 21/00; H04R 2201/003; H04R 19/005; H04R 1/005; H04R 19/013; B06B 1/0292
See application file for complete search history.

(56) References Cited

U.S. PATENT DOCUMENTS

2013/0056841 A1* 3/2013 Hsieh ..... H01G 5/18 257/419
2017/0078802 A1* 3/2017 Ravnkilde ..... B06B 1/0292

OTHER PUBLICATIONS

Iguchi et al., Silicon Microphone with Wide Frequency Range and High Linearity, Aug. 22, 2006, pp. 420-425.*
Homentcovschi, D., et al., "Viscous damping of perforated planar micromechanical structures," Sensors and Actuators, A 119, pp. 544-552(2005).
Homentcovschi, Dorel, et al., "Modeling of viscous damping of perforated planar microstructures: applications in acoustics," J. Acoust. Soc. Am., 116 (5), 9 pages (Nov. 2004).
Homentcovschi, Dorel, et al., "Viscous microstructural dampers with aligned holes: Design procedure including the edge correction," J. Acoust. Soc. Am., 122(3), 12 pages (Sep. 2007).

* cited by examiner

REDUCED-DAMPING ACOUSTIC HOLES

BACKGROUND

The following description is provided to assist the understanding of the reader. None of the information provided or references cited is admitted to be prior art.

Microelectromechanical systems (MEMS) such as MEMS microphones include a diaphragm and a backplate. An air gap between the diaphragm and the backplate is squeezed as the diaphragm oscillates, inducing squeeze film damping which is one of the major sources of noise in MEMS devices. Traditionally, holes are introduced within the backplate to reduce the squeeze film damping by allowing air to flow through the holes. However, the squeeze film damping may only be reduced so much before the sensitivity of the MEMS device is hindered since the size of the holes reduces the effective capacitive surface area of the backplate, which thereby reduces the sensitivity of the MEMS device.

SUMMARY

In general, one aspect of the subject matter described in this specification can be embodied as a microelectromechanical systems (MEMS) device. The MEMS device includes a diaphragm and a backplate spaced a distance from the diaphragm forming an air gap therebetween. The backplate includes a first surface facing toward the diaphragm and an opposing second surface facing away from the diaphragm. The first surface and the opposing second surface of the backplate cooperatively define a plurality of through-holes that extend through the backplate allowing air from the air gap to flow therethrough. Each of the plurality of through-holes include an first aperture disposed along the first surface, a second aperture disposed along the opposing second surface, and a sidewall extending between the first surface and the opposing second surface. According to an exemplary embodiment, the first aperture and the second aperture have different dimensions (e.g., sizes, diameters, widths, shapes, areas, etc.).

In general, another aspect of the subject matter described in this specification can be embodied in a backplate for a microelectromechanical systems (MEMS) device. The backplate includes a first surface configured to face toward a diaphragm and an opposing second surface configured to face away from the diaphragm. The first surface has a first plurality of apertures that define a first perforation ratio of the first surface. The opposing second surface has a second plurality of apertures that define a second perforation ratio of the opposing second surface. According to an exemplary embodiment, the first perforation ratio of the first surface is less than the second perforation ratio of the opposing second surface.

In general, another aspect of the subject matter described in this specification can be embodied in a microelectromechanical systems (MEMS) device. The MEMS device includes a diaphragm and a backplate spaced a distance from the diaphragm forming an air gap therebetween. The backplate includes a first surface facing toward the diaphragm and an opposing second surface facing away from the diaphragm. The first surface has a first plurality of apertures that define a first perforation ratio of the first surface. The opposing second surface has a second plurality of apertures that define a second perforation ratio of the opposing second surface. According to an exemplary embodiment, the first perforation ratio of the first surface is less than the second perforation ratio of the opposing second surface.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figures 1A, 1B:
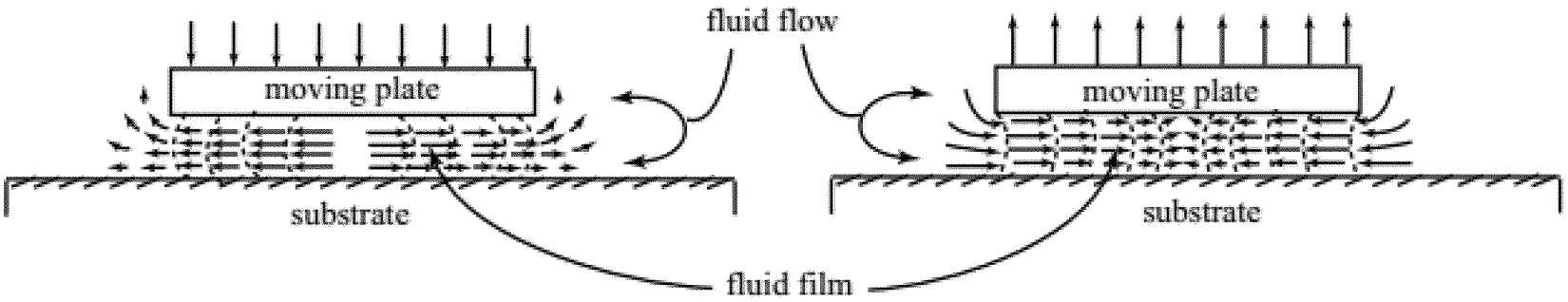
FIGS. 1A-1B are illustrations of squeeze film damping between a fixed substrate and a moving plate in accordance with various implementations.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

According to an exemplary embodiment, a MEMS device (e.g., a MEMS microphone; for a smartphone, a tablet, a laptop, a hearing aid, a video camera, a communications device; etc.) includes a diaphragm and at least one backplate. The backplate is positioned relative to the diaphragm with a spaced relationship such that an air gap is formed therebetween. The diaphragm is configured to receive and convert acoustic energy (e.g., sound energy, etc.) into an electrical signal. During such a conversion, the acoustic energy causes the diaphragm to flex and oscillate back and forth (e.g., vibrate, etc.) from impinging waves of acoustic pressure thereon. The air gap between the diaphragm and the backplate is squeezed as the diaphragm flexes, inducing squeeze film damping (SFD). SFD is one of the major sources of noise in such MEMS devices. Traditionally, through-holes may be introduced within the backplate to reduce the SFD by allowing air within the air gap to flow through the through-holes. However, the effective capacitive surface area of the backplate is reduced from the introduction of the through-holes. As the effective capacitive surface area of the backplate is reduced (e.g., the size and/or number of the through-holes is increased, etc.), so does the inherent sensitivity of the MEMS device. Thus, increasing the size and/or number of through-holes may advantageously reduce the SFD, but consequentially reduces the effective capacitive surface area of the backplate which thereby adversely affects the sensitivity of the MEMS device. According to an exemplary embodiment, the backplate of the present disclosure is configured such that the shape of the through-holes is modified such that the effective capacitive surface area of the backplate facing the diaphragm may be unchanged or increased to maintain or increase the sensitivity of the MEMS device, while effectively reducing SFD to improve the signal-to-noise ratio (SNR) of the MEMS device (e.g., relative to a traditional backplate with through-holes having straight, vertical profiles, etc.).

Referring now to FIGS. 1A-1B, an illustration of SFD between a planar structure (e.g., a moving plate, a diaphragm, etc.) and a fixed substrate (e.g., a backplate, etc.) is shown. As the planar structure oscillates normal to the fixed substrate, an air-film between the planar structure and the fixed substrate is squeezed causing lateral fluid motion within an air gap therebetween. A change in pressure in the air gap is caused due to the viscous flow of the air. The forces due to built-up pressure act against the movement of the planar structure. Thus, the air-film acts as a damper which causes SFD. SFD is prevalent in systems in which the thickness of the air-gap is sufficiently small (e.g., a few microns, etc.) compared to the lateral dimensions of the planar structure. Smaller air-gap thicknesses may lead to increased SFD.

Figure 2:
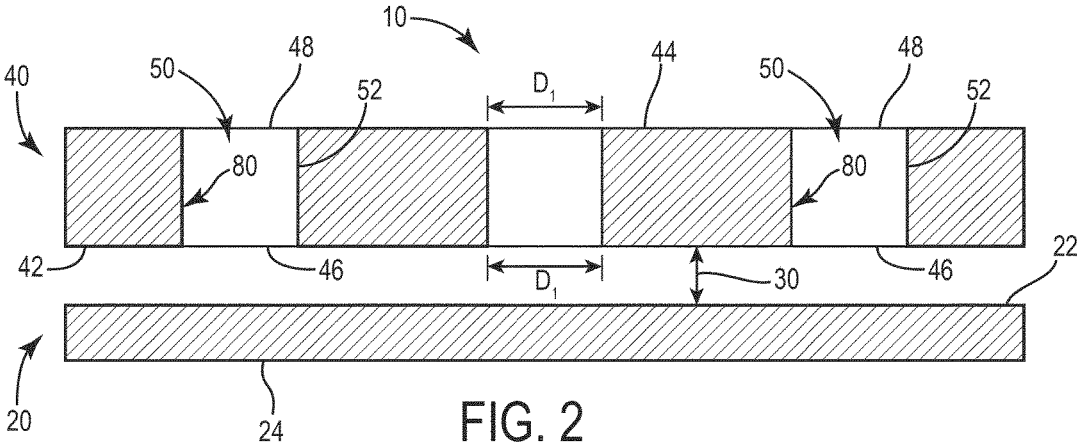
FIG. 2 is a cross-sectional view of a diaphragm and a backplate of a MEMS device having through-holes with a straight, vertical profile in accordance with various implementations.

Referring now to FIG. 2, a MEMS device, shown as MEMS device 10, includes a flexible, moving plate, shown as diaphragm 20, and a traditional backplate, shown as backplate 40. The diaphragm 20 has a first face, shown as first surface 22, and an opposing second face, shown as second surface 24. The backplate 40 has a first face, shown as interior surface 42, and an opposing second face, shown as exterior surface 44. As shown in FIG. 2, the interior surface 42 of the backplate 40 is positioned relative to the first surface 22 of the diaphragm 20 with a spaced relationship such that a gap, shown as air gap 30, is formed therebetween. The second surface 24 of the diaphragm 20 may be configured to receive acoustic energy (e.g., sound energy, etc.) from sound waves impinging thereon that causes the diaphragm 20 to vibrate (e.g., flex, oscillate, etc.) such that the MEMS device 10 may convert such vibration into an electrical signal (e.g., to be transmitted to a speaker, etc.). As the diaphragm 20 vibrates, the air gap 30 is squeezed (like shown in FIGS. 1A-1B), inducing SFD.

As shown in FIG. 2, the backplate 40 defines a plurality of through-holes, shown as through-holes 50, that extend through the backplate 40 (i.e., from the interior surface 42 to the exterior surface 44). According to an exemplary embodiment, the through-holes 50 are positioned to facilitate allowing air from the air gap 30 to flow therethrough to thereby reduce the SFD. As shown in FIG. 2, each of the through-holes 50 include a first aperture, shown as interior aperture 46, disposed along the interior surface 42 of the backplate 40, a second aperture, shown as exterior aperture 48, disposed along the exterior surface 44 of the backplate 40, and a sidewall, shown as sidewall 52, extending between the interior surface 42 and the exterior surface 44 of the backplate 40.

The interior apertures 46 define a first perforation ratio of the interior surface 42 (e.g., the area of the interior apertures 46 relative to the surface area of the interior surface 42 of the backplate 40 without the interior apertures 46, etc.) and the exterior apertures 48 define a second perforation ratio of the exterior surface 44 (e.g., the area of the exterior apertures 48 relative to the surface area of the exterior surface 44 of the backplate 40 without the exterior apertures 48, etc.). As shown in FIG. 2, the sidewalls 52 of the through-holes 50 have a vertical profile, shown as straight profile 80. Therefore, the interior apertures 46 and the exterior apertures 48 have the same diameter, shown as diameter $D_1$, such that the first perforation ratio of the interior surface 42 is equal to the second perforation ratio of the exterior surface 44.

While the backplate 40 may reduce the SFD induced within the MEMS device 10 due to the introduction of the through-holes 50, the effective capacitive surface area of the backplate 40 (e.g., the surface area of the interior surface 42, the surface area of the interior surface 42 of the backplate 40 without the interior apertures 46 minus the area of the interior apertures 46, etc.) is reduced, and thus the sensitivity of the MEMS device 10 is also reduced. To further reduce the SFD, the diameter $D_1$ of both the interior apertures 46 and the exterior apertures 48 of the backplate 40 must be increased, thereby further reducing the effective capacitive surface area of the backplate 40 and further reducing the sensitivity of the MEMS device 10. Such a reduction in the sensitivity may adversely affect the performance and operation of the MEMS device 10.

According to the exemplary embodiment shown in FIGS. 3-9, a MEMS device, shown as MEMS device 100, includes a flexible substrate, shown as diaphragm 120, and an improved backplate, shown as backplate 140. In one embodiment, the diaphragm 120 is a freeplate diaphragm. In another embodiment, the diaphragm 120 is a constrained diaphragm. In still other embodiments, the diaphragm 120 is still another type of diaphragm. According to an exemplary embodiment, the backplate 140 of the MEMS device 100 is configured to maintain or increase the effective capacitive surface area thereof and therefore maintain or increase the sensitivity of the MEMS device 100, while effectively reducing SFD to improve the SNR of the MEMS device 100 (e.g., relative to traditional backplates such as the backplate 40 of the MEMS device 10, etc.).

Figure 3:
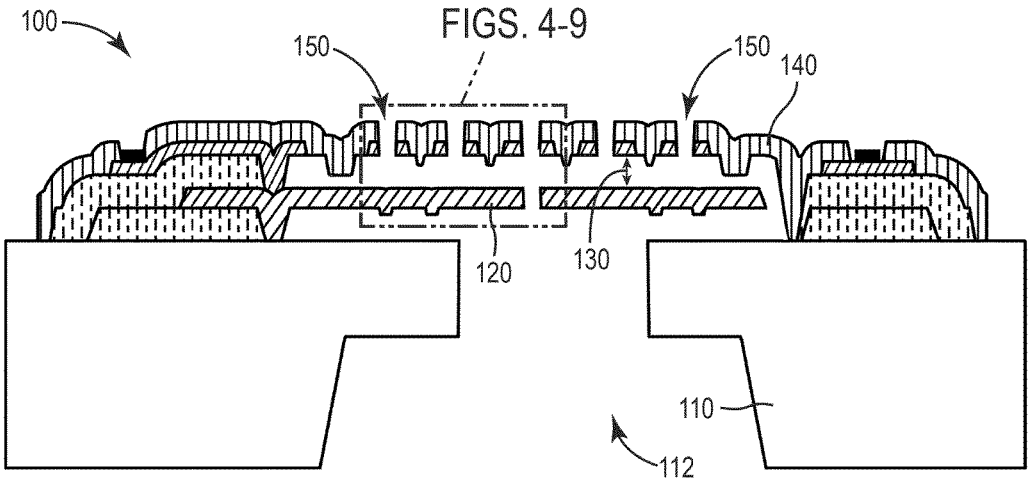
FIG. 3 is a cross-sectional view of a MEMS device including a diaphragm and a backplate having through-holes in accordance with various implementations.

As shown in FIG. 3, the MEMS device 100 includes a body, shown as body 110, that defines a cavity, shown as sound bore 112. As shown in FIGS. 4-9, the diaphragm 120 has a first face, shown as first surface 122, positioned to face toward the backplate 140 and an opposing second face, shown as second surface 124, positioned to face toward the sound bore 112. The backplate 140 has a first face, shown as interior surface 142, positioned to face toward the diaphragm 120 and an opposing second face, shown as exterior surface 144, positioned to face an exterior environment. According to an exemplary embodiment, the second surface 124 of the diaphragm 120 is configured to receive acoustic energy (e.g., sound energy, etc.) from sound waves propagating through the sound bore 112 of the MEMS device 100 that causes the diaphragm 120 to vibrate (e.g., flex, oscillate, etc.). The MEMS device 100 may convert such vibration into an electrical signal (e.g., to be transmitted to a speaker, etc.). As shown in FIGS. 3-9, the backplate 140 is positioned relative to the diaphragm 120 with a spaced relationship such that a gap, shown as air gap 130, is formed between the first surface 122 of the diaphragm 120 and the interior surface 142 of the backplate 140. As the diaphragm 120 vibrates, the air gap 130 is squeezed (like shown in FIGS. 1A-1B), inducing SFD.

As shown in FIGS. 3-9, the backplate 140 defines a plurality of through-holes, shown as through-holes 150, that extend through the backplate 140 (i.e., from the interior surface 142 to the exterior surface 144). According to an exemplary embodiment, the through-holes 150 are positioned to facilitate allowing air from the air gap 130 to flow therethrough to thereby reduce the SFD (e.g., as the diaphragm 120 oscillates, etc.). As shown in FIGS. 4-9, each of the through-holes 150 include a first aperture, shown as interior aperture 146, disposed along the interior surface 142 of the backplate 140, a second aperture, shown as exterior aperture 148, disposed along the exterior surface 144 of the backplate 140, and a sidewall, shown as sidewall 152, extending between the interior surface 142 and the exterior surface 144 of the backplate 140.

The interior apertures 146 define a first perforation ratio of the interior surface 142 (e.g., the area of the interior apertures 146 relative to the surface area of the interior surface 142 of the backplate 140 without the interior apertures 146, etc.) and the exterior apertures 148 define a second perforation ratio of the exterior surface 144 (e.g., the area of the exterior apertures 148 relative to the surface area of the exterior surface 144 of the backplate 140 without the exterior apertures 148, etc.). According to an exemplary embodiment, the interior apertures 146 and the exterior apertures 148 have different dimensions (e.g., shapes, diameters, widths, areas, etc.). According to the exemplary embodiments shown in FIGS. 3-9, the interior apertures 146 and the exterior apertures 148 are round (e.g., circular, etc.) such that the dimensions of the interior apertures 146 and the exterior apertures 148 may be referred to in terms of diameters. In other embodiments, at least a portion of the interior apertures 146 and/or the exterior apertures 148 have another shape (e.g., other than a circle such as an oval, a diamond, a rectangle, a triangle, a square, a pentagon, a hexagon, an octagon, a trapezoid, etc.).

As shown in FIGS. 4-9, the interior apertures 146 have a first diameter, shown as interior diameter $D_2$, and the exterior apertures have a second, larger diameter, shown as exterior diameter $D_3$, such that the first perforation ratio of the interior surface 142 is less than the second perforation ratio of the exterior surface 144. The first perforation ratio of the interior surface 142 may range anywhere from 1% to 99%. The second perforation ratio of the exterior surface 144 may range anywhere from 2% to 100%. According to an exemplary embodiment, the first perforation ratio of the interior surface 142 is half the second perforation ratio of the exterior surface 144 (e.g., 34% relative to 68%, 25% relative to 50%, 40% relative to 80%, etc.). In other embodiments, the first perforation ratio of the interior surface 142 is a different proportion of the second perforation ratio of the exterior surface 144 (e.g., a quarter, a third, a fifth, etc.).

According to an exemplary embodiment, the interior diameter $D_2$ of the interior apertures 146 of the backplate 140 is less than or equal to the interior diameter $D_1$ of the interior apertures 46 of the backplate 40. Therefore, the first perforation ratio of the interior surface 142 of the backplate 140 may be less than or equal to the perforation ratio of the interior surface 42 of the backplate 40. Thus, the effective capacitive surface area of the interior surface 142 of the backplate 140 may be greater than or equal to the effective capacitive surface area of the interior surface 42 of the backplate 40 such that the sensitivity of the MEMS device 100 either remains the same or increases (e.g., relative to the MEMS device 10, etc.). According to an exemplary embodiment, the exterior diameter $D_3$ of the exterior apertures 148 of the backplate 140 is greater than the exterior diameter $D_1$ of the exterior apertures 48 of the backplate 40. Therefore, the second perforation ratio of the exterior surface 144 of the backplate 140 may be greater than the perforation ratio of the exterior surface 44 of the backplate 40. According to an exemplary embodiment, maintaining or decreasing the first perforation ratio of the interior surface 142 of the backplate 140, while increasing the second perforation ratio of the exterior surface 144 of the backplate 140 reduces the SFD (e.g., relative to the backplate 40 of the MEMS device 10, etc.) without adversely affecting (and potentially increasing) the sensitivity of the MEMS device 100.

As shown in FIGS. 4-9, the sidewalls 152 of the through-holes 150 have various profiles (e.g., notched, stepped, linearly sloped, non-linear, etc.) that may be used to decrease SFD and maintain or increase the effective capacitive surface area of the interior surface 142 of the backplate 140, while maintaining or increasing the sensitivity of the MEMS device 100.

Figure 4:
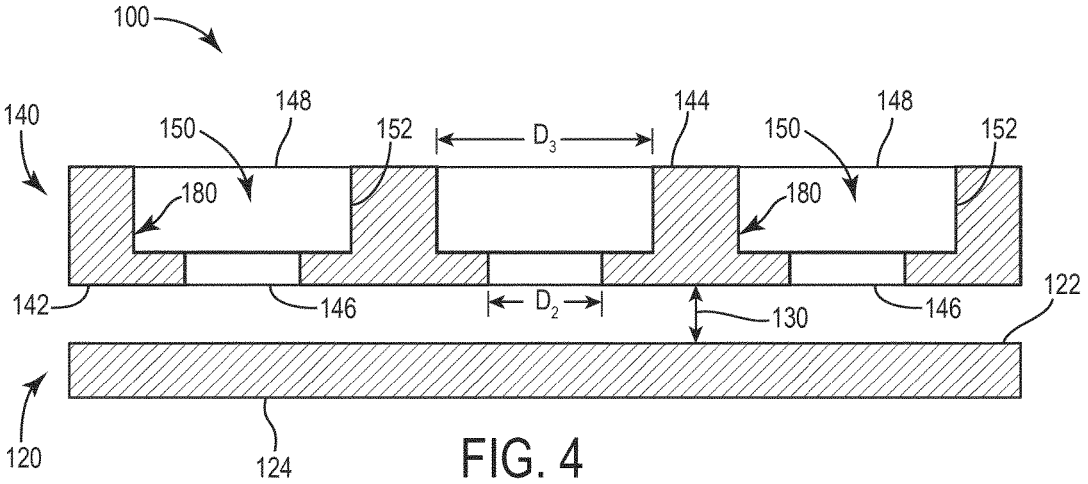
FIG. 4 is a detailed cross-sectional view of the diaphragm and the backplate of the MEMS device of FIG. 3, the backplate having through-holes with a notched profile in accordance with various implementations.

As shown in FIG. 4, the sidewalls 152 of the through-holes 150 have a first profile, shown as notched profile 180. The notched profile 180 of the sidewalls 152 includes a first portion extending from the interior surface 142 to an intermediate position (e.g., along a thickness of the backplate 140, a first height of the backplate 140, etc.) and having the interior diameter $D_2$. The notched profile 180 of the sidewalls 152 additionally includes a second portion extending from the first portion to the exterior surface 144 (e.g., a second height of the backplate 140, etc.) and having the exterior diameter $D_3$. The transition between the first portion and the second portion of the notched profile 180 of the sidewalls 152 forms an abrupt change in the diameter of the through-holes 150 (e.g., a right angle, a corner, an edge, etc.). In some embodiment, the transition between the first portion and the second portion of the notched profile 180 has a filleted portion, a chamfered portion, or an otherwise smoothed edge.

Figure 5:
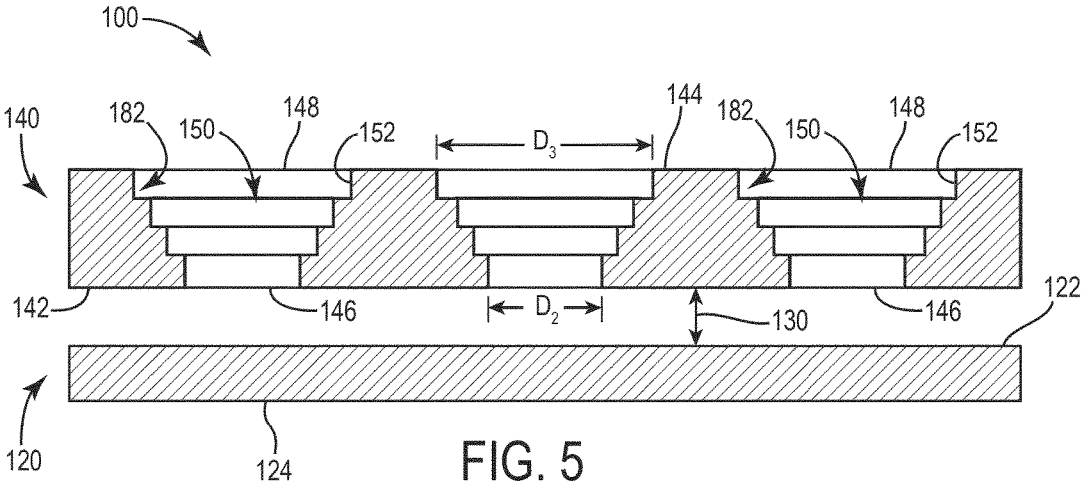
FIG. 5 is a detailed cross-sectional view of the diaphragm and the backplate of the MEMS device of FIG. 3, the backplate having through-holes with a stepped profile in accordance with various implementations.

As shown in FIG. 5, the sidewalls 152 of the through-holes 150 have a second profile, shown as stepped profile 182. The stepped profile 182 of the sidewalls 152 includes a first portion extending from the interior surface 142 (e.g., a first height of the backplate 140, etc.) and having the interior diameter $D_2$, a second portion extending to the exterior surface 144 (e.g., a second height of the backplate 140, etc.) and having the exterior diameter $D_3$, and one or more intermediate portions (e.g., one, two, three, ten, etc.) positioned between the first portion and the second portion. Each of the intermediate portions may have a different diameter between the interior diameter $D_2$ and the exterior diameter $D_3$ that increases from the first portion to the second portion. The transition between the each portion of the stepped profile 182 of the sidewalls 152 may have an abrupt change in the diameter of the through-holes 150 (e.g., a right angle, an edge, a corner, etc.). In some embodiment, the transition between the portions of the stepped profile 182 has a filleted portion, a chamfered portion, or an otherwise smoothed edge.

Figure 6:
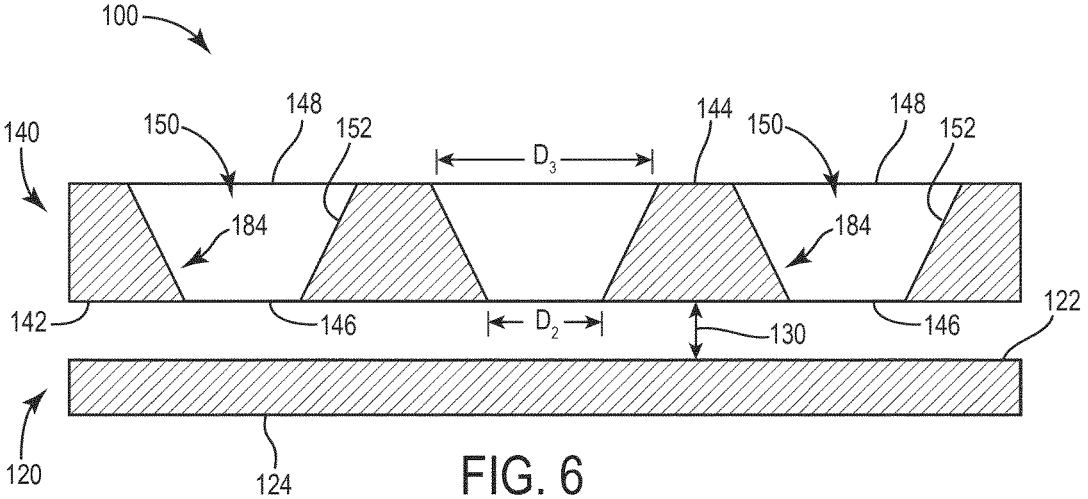
FIG. 6 is a detailed cross-sectional view of the diaphragm and the backplate of the MEMS device of FIG. 3, the backplate having through-holes with a linearly sloped profile in accordance with various implementations.

As shown in FIG. 6, the sidewalls 152 of the through-holes 150 have a third profile, shown as linearly sloped profile 184. The linearly sloped profile 184 of the sidewalls 152 includes a variable diameter than increases linearly (e.g., tapers outward linearly, etc.) from the interior surface 142 having the interior diameter $D_2$ to the exterior surface 144 having the exterior diameter $D_3$. The angle of the sidewalls 152 having the linearly sloped profile 184 (e.g., relative to a horizontal, to the interior surface 142, etc.) may range from one to eighty-nine degrees. The slope/angle of the linearly sloped profile 184 may be defined by the selected diameters of the interior apertures 146 (i.e., the interior diameter $D_2$) and the exterior apertures 148 (i.e., the exterior diameter $D_3$).

Figure 7:
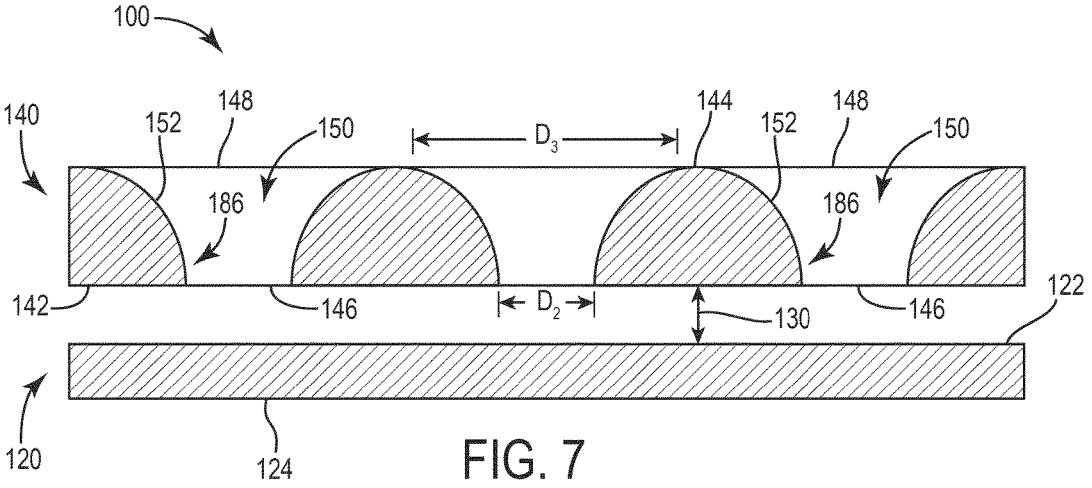
FIG. 7 is a detailed cross-sectional view of the diaphragm and the backplate of the MEMS device of FIG. 3, the backplate having through-holes with a first non-linear profile in accordance with various implementations.

As shown in FIG. 7, the sidewalls 152 of the through-holes 150 have a fourth profile, shown as first non-linear profile 186. The first non-linear profile 186 of the sidewalls 152 includes a variable diameter than increases non-linearly from the interior surface 142 having the interior diameter $D_2$ to the exterior surface 144 having the exterior diameter $D_3$. The variable diameter of the first non-linear profile 186 may increase at a relatively lesser rate towards the interior surface 142 than the exterior surface 144 (e.g., such that the first non-linear profile 186 approaches a horizontal asymptote near the exterior surface 144, similar to a logarithmic curve, a horn-shaped through-hole, etc.).

Figure 8:
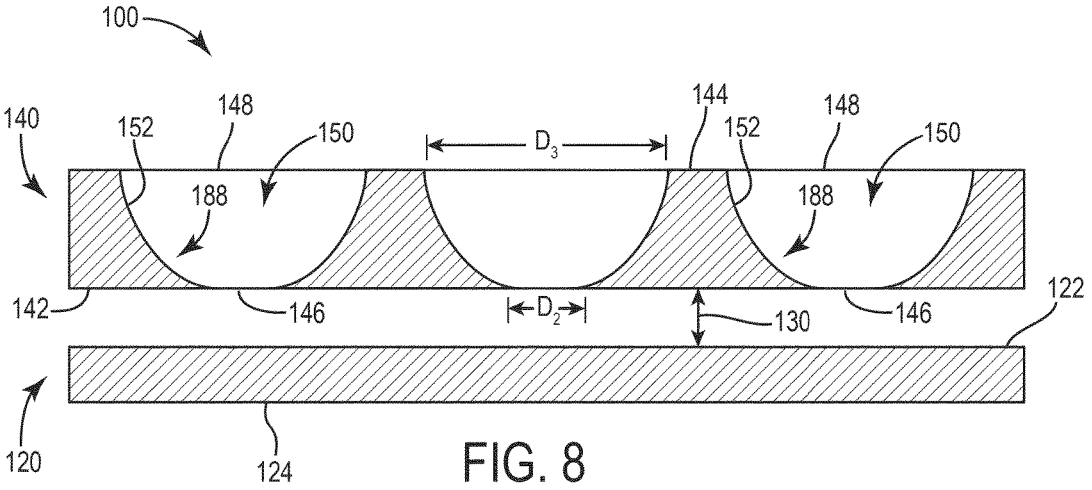
FIG. 8 is a detailed cross-sectional view of the diaphragm and the backplate of the MEMS device of FIG. 3, the backplate having through-holes with a second non-linear profile in accordance with various implementations.

As shown in FIG. 8, the sidewalls 152 of the through-holes 150 have a fifth profile, shown as second non-linear profile 188. The second non-linear profile 188 of the sidewalls 152 includes a variable diameter than increases non-linearly from the interior surface 142 having the interior diameter $D_2$ to the exterior surface 144 having the exterior diameter $D_3$. The variable diameter of the second non-linear profile 188 may increase at an increasing rate from the interior surface 142 to the exterior surface 144 (e.g., similar to a parabolic curve, an exponential curve, etc.).

Figure 9:
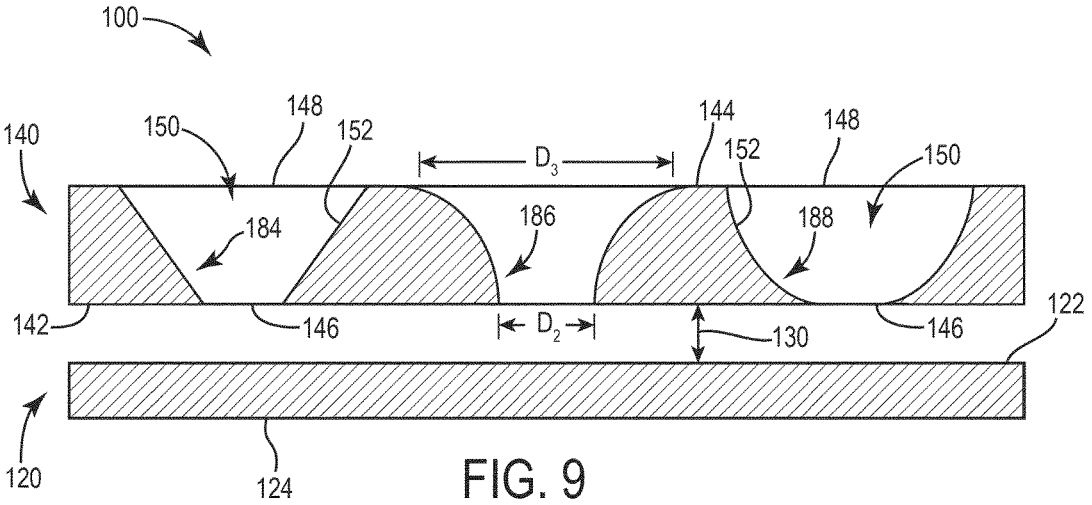
FIG. 9 is a detailed cross-sectional view of the diaphragm and the backplate of the MEMS device of FIG. 3, the backplate having through-holes with various profiles in accordance with various implementations.

In some embodiments, the backplate 140 has through-holes 150 having sidewalls 152 with various, different profiles. As shown in FIG. 9, the backplate 140 includes through-holes 150 with the linearly sloped profile 184, the first non-linear profile 186, and the second non-linear profile 188. In various other embodiments, the sidewalls 152 of the through-holes 150 of the backplate 140 have the straight profile 80, the notched profile 180, the stepped profile 182, the linearly sloped profile 184, the first non-linear profile 186, and/or the second non-linear profile 188.

According to an exemplary embodiment, the SFD experienced by a MEMS device may be determined using the following expressions:

$$C_{total} = C_{gap} + C_{holes} \tag{1}$$

$$C_{gap} = N\left(\frac{3\pi}{2}\right)\left(\frac{\mu}{Q_{ch}}\right)\left(\frac{r_1^4}{g_0^3}\right)K(\beta) \tag{2}$$

$$C_{holes} = N \cdot 8\pi \cdot T_p\left(\frac{\mu}{Q_{th}}\right)\left(\frac{r_1^4}{r_0^4}\right) \tag{3}$$

where $C_{total}$ is s the total SFD coefficient for the MEMS device (e.g., the MEMS device 10, the MEMS device 100, etc.), $C_{gap}$ is the SFD coefficient due to an air gap (e.g., the air gap 30, the air gap 130, etc.), and $C_{holes}$ is the SFD coefficient due to through-holes (e.g., the through-holes 50, the through-holes 150, etc.).

Referring now to Table 1, the total calculated SFD coefficient for various profiles of a backplate (e.g., the backplate 40, the backplate 140, etc.) is shown. For the straight profile 80 of the backplate 40, the diameter $D_1$ was selected such that the interior surface 42 and the exterior surface 44 has a perforation ratio of 34%. For the notched profile 180 of the backplate 140, the interior diameter $D_2$ was selected such that the interior surface 142 has a perforation ratio of 34% and the exterior diameter $D_3$ was selected such that the exterior surface 144 has a perforation ratio of 68%. For the linearly sloped profile 184 of the backplate 140, the interior diameter $D_2$ was selected such that the interior surface 142 has a perforation ratio of 34% and the exterior diameter $D_3$ was selected such that the exterior surface 144 has a perforation ratio of 68%. Therefore, the effective capacitive area of the interior surface 42 of the backplate 40 and the effective capacitive area of the interior surface 142 of the backplate 140 are identical, and therefore so is the sensitivity of the respective MEMS devices.

As shown in Table 1, the SFD coefficient due to the through-holes (e.g., the through-holes 50, the through-holes 150, etc.) is dominant and significant to the total SFD coefficient. However, by changing the perforation ratio of the exterior surface 144 of the backplate 140 relative to the perforation ratio of the exterior surface 44 of the backplate 40, the total SFD coefficient may be reduced. Therefore, the backplate 140 of the MEMS device 100 having at least one of the various shaped profiles of the through-holes 150 (e.g., the notched profile 180, the stepped profile 182, the linearly sloped profile 184, the first non-linear profile 186, the second non-linear profile 188, etc.) facilitates maintaining or increasing the effective capacitive surface area of the interior surface 142, and therefore maintaining or increasing the sensitivity of the MEMS device 100, while effectively reducing SFD and therefore total noise to improve the SNR of the MEMS device 100 (e.g., relative to the backplate 40 of the MEMS device 10, etc.).

TABLE 1

Squeeze Film Damping for Various Through-Hole Profiles ($\times 10^{-6}$)

| Hole Profile | Perforation Ratio: Interior | Perforation Ratio: Exterior | $C_{gap}$ $\left[\frac{N \cdot s}{m}\right]$ | $C_{hole}$ $\left[\frac{N \cdot s}{m}\right]$ | $C_{total}$ $\left[\frac{N \cdot s}{m}\right]$ |
|---|---|---|---|---|---|
| Straight Profile 80 | 34% | 34% | 3.2 | 7.3 | 10.5 |
| Notched Profile 180 | 34% | 68% | 3.2 | 3.5 | 6.7 |
| Linearly Sloped Profile 184 | 34% | 68% | 3.2 | 3.4 | 6.6 |

Figure 10:
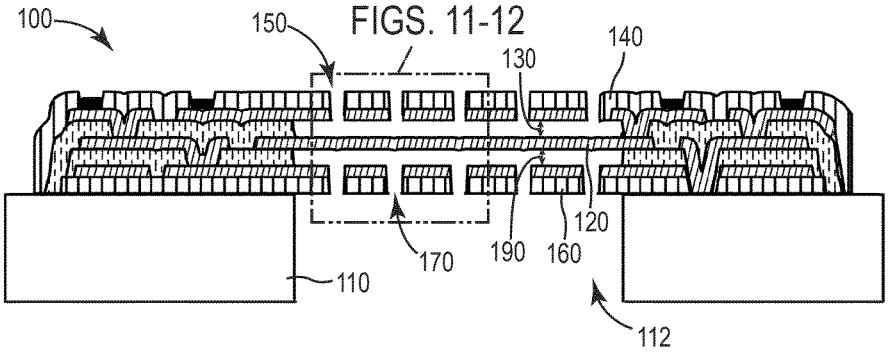
FIG. 10 is a cross-sectional view of a MEMS device including a diaphragm and a dual backplate having through-holes in accordance with various implementations.
Figure 11:
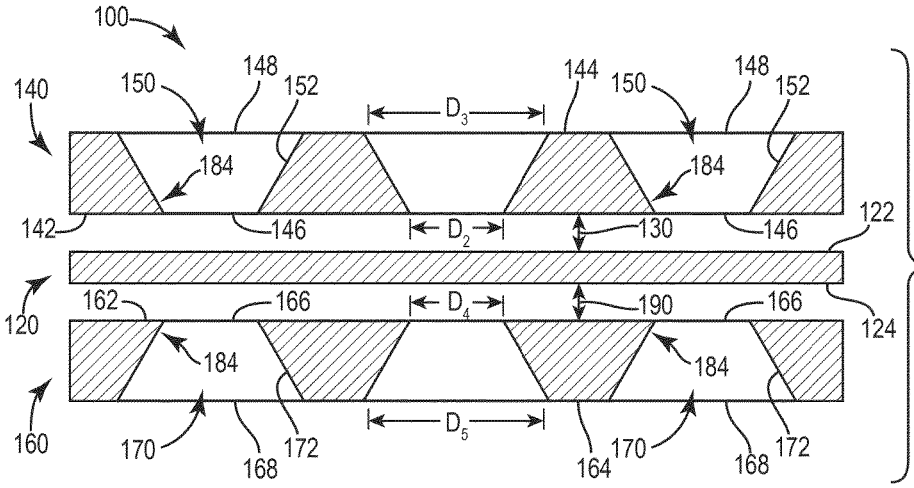
FIG. 11 is a detailed cross-sectional view of the diaphragm and the dual backplate of the MEMS device of FIG. 10, the dual backplate having through-holes with uniform profiles in accordance with various implementations.
Figure 12:
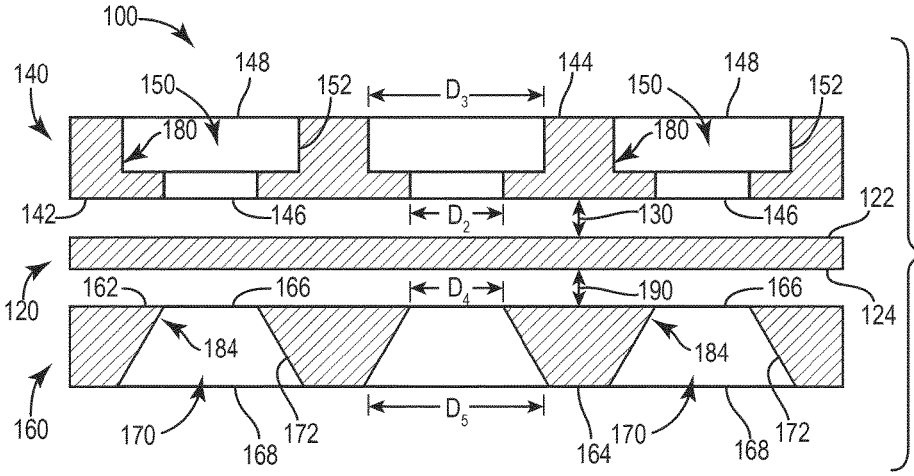
FIG. 12 is a detailed cross-sectional view of the diaphragm and the dual backplate of the MEMS device of FIG. 10, the dual backplate having through-holes with various profiles in accordance with various implementations.

According to the exemplary embodiment shown in FIGS. 10-12, the MEMS device 100 includes a dual backplate arrangement having both the backplate 140 (e.g., a first backplate, a rear backplate, etc.) and a second backplate (e.g., a front backplate, etc.), shown as backplate 160. As shown in FIGS. 11-12, the backplate 160 has a first face, shown as interior surface 162, positioned to face toward the second surface 124 of the diaphragm 120 and an opposing second face, shown as exterior surface 144, positioned to face the sound bore 112. As shown in FIGS. 10-12, the backplate 160 is positioned relative to the diaphragm 120 with a spaced relationship such that a second gap, shown as air gap 190, is formed between the second surface 124 of the diaphragm 120 and the interior surface 162 of the backplate 160. As the diaphragm 120 vibrates, the air gap 190 is squeezed (like shown in FIGS. 1A-1B), inducing SFD.

As shown in FIGS. 10-12, the backplate 160 defines a plurality of through-holes, shown as through-holes 170, that extend through the backplate 160 (i.e., from the interior surface 162 to the exterior surface 164). According to an exemplary embodiment, the through-holes 170 are positioned to facilitate allowing air from the air gap 190 to flow therethrough to thereby reduce the SFD (e.g., as the diaphragm 120 oscillates, etc.). As shown in FIGS. 11-12, each of the through-holes 170 include a first aperture, shown as interior aperture 166, disposed along the interior surface 162 of the backplate 160, a second aperture, shown as exterior aperture 168, disposed along the exterior surface 164 of the backplate 160, and a sidewall, shown as sidewall 172, extending between the interior surface 162 and the exterior surface 164 of the backplate 160.

The interior apertures 166 define a third perforation ratio of the interior surface 162 (e.g., the area of the interior apertures 166 relative to the surface area of the interior surface 162 of the backplate 160 without the interior apertures 166, etc.) and the exterior apertures 168 define a fourth perforation ratio of the exterior surface 164 (e.g., the area of the exterior apertures 168 relative to the surface area of the exterior surface 164 of the backplate 160 without the exterior apertures 168, etc.). According to an exemplary embodiment, the interior apertures 166 and the exterior apertures 168 have different dimensions (e.g., shapes, diameters, widths, areas, etc.). According to the exemplary embodiments shown in FIGS. 10-12, the interior apertures 166 and the exterior apertures 168 are round (e.g., circular, etc.) such that the dimensions of the interior apertures 166 and the exterior apertures 168 may be referred to in terms of diameters. In other embodiments, at least a portion of the interior apertures 166 and/or the exterior apertures 168 have another shape (e.g., other than circle such as an oval, a diamond, a rectangle, a triangle, a square, a pentagon, a hexagon, an octagon, a trapezoid, etc.).

As shown in FIGS. 11-12, the interior apertures 166 have a third diameter, shown as interior diameter $D_4$, and the exterior apertures have a fourth, larger diameter, shown as exterior diameter $D_5$, such that the third perforation ratio of the interior surface 162 is less than the fourth perforation ratio of the exterior surface 164. The third perforation ratio of the interior surface 162 may range anywhere from 1% to 70%. The fourth perforation ratio of the exterior surface 164 may range anywhere from 2% to 100%. In one embodiment, the third perforation ratio of the interior surface 162 is the same as the first perforation ratio of the interior surface 142 (e.g., the interior diameter $D_2$ is equal to the interior diameter $D_4$, etc.) and the fourth perforation ratio of the exterior surface 164 is the same as the second perforation ratio of the exterior surface 144 (e.g., the exterior diameter $D_3$ is equal to the exterior diameter $D_5$, etc.). In other embodiments, the third perforation ratio is different than the first perforation ratio and/or the fourth perforation ratio is different than the second perforation ratio.

As shown in FIG. 11, the sidewalls 172 of the through-holes 170 and the sidewalls 152 of the through-holes 150 have a uniform profile (e.g., the linearly sloped profile 184, etc.). It should be understood that the sidewalls 172 may have any of the profiles described in regards to sidewalls 152 (e.g., the notched profile 180, the stepped profile 182, the linearly sloped profile 184, the first non-linear profile 186, the second non-linear profile 188, etc.). As shown in FIG. 12, the sidewalls 172 of the through-holes 170 have a first profile (e.g., the linearly sloped profile 184, etc.) and the sidewalls 152 of the through-holes 150 have a different, second profile (e.g., the notched profile 180, etc.). It should be understood that the sidewalls 172 may have one of the notched profile 180, the stepped profile 182, the linearly sloped profile 184, the first non-linear profile 186, and the second non-linear profile 188 and the sidewalls 152 may have a different one of the notched profile 180, the stepped profile 182, the linearly sloped profile 184, the first non-linear profile 186, and the second non-linear profile 188. In other embodiments, the through-holes 170 of the backplate 160 have various different profiles (e.g., any combination of the straight profile 80, the notched profile 180, the stepped profile 182, the linearly sloped profile 184, the first non-linear profile 186, and the second non-linear profile 188; similar to that shown in FIG. 9; etc.).

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A microelectromechanical systems (MEMS) device, comprising:

a diaphragm; and a backplate spaced a distance from the diaphragm forming an air gap therebetween, the backplate including:

a first surface facing toward the diaphragm; and an opposing second surface facing away from the diaphragm;

wherein the first surface and the opposing second surface of the backplate cooperatively define a plurality of through-holes that extend through the backplate allowing air from the air gap to flow therethrough;

wherein each of the plurality of through-holes include a first aperture disposed along the first surface, a second aperture disposed along the opposing second surface, and a sidewall extending between the first surface and the opposing second surface;

wherein the first aperture has a first diameter and the second aperture has a second diameter, wherein the second diameter is greater than the first diameter; and wherein the sidewall of at least one of the plurality of through-holes has a non-linear profile.

2. The MEMS device of claim 1, wherein the sidewall of at least one of the plurality of through-holes has a notched profile.

3. The MEMS device of claim 1, wherein the sidewall of at least one of the plurality of through-holes has a stepped profile.

4. The MEMS device of claim 1, wherein the sidewall of at least one of the plurality of through-holes has a linearly sloped profile.

5. The MEMS device of claim 1, further comprising a second backplate positioned on an opposite side of the diaphragm relative to the first backplate, the second backplate spaced a second distance from the diaphragm forming a second air gap therebetween.

6. The MEMS device of claim 5, wherein the second backplate includes:

a third surface facing the opposite side of the diaphragm; and an opposing fourth surface facing away from the opposite side of the diaphragm;

wherein the third surface and the opposing fourth surface of the second backplate cooperatively define a second plurality of through-holes that extend through the second backplate;

wherein each of the second plurality of through-holes include a third aperture disposed along the third surface, a fourth aperture disposed along the opposing fourth surface, and a second sidewall extending between the third surface and the opposing fourth surface.

7. The MEMS device of claim 6, wherein the first sidewall of each of the plurality of through-holes defined by the first surface and the opposing second surface has a first profile and the second sidewall of each of the second plurality of through-holes has a second profile.

8. The MEMS device of claim 7, wherein the first profile and the second profile are identical.

9. The MEMS device of claim 7, wherein the first profile and the second profile are different.

10. The MEMS device of claim 1, wherein the MEMS device includes a MEMS microphone.

11. A backplate for a microelectromechanical systems (MEMS) device, comprising:

a first surface configured to face toward a diaphragm, the first surface having a first plurality of apertures that define a first perforation ratio of the first surface; and an opposing second surface configured to face away from the diaphragm, the opposing second surface having a second plurality of apertures that define a second perforation ratio of the opposing second surface;

wherein the first perforation ratio of the first surface is less than the second perforation ratio of the opposing second surface;

wherein the first plurality of apertures and the second plurality of apertures are positioned to align, thereby cooperatively forming a plurality of through-holes that extend through the backplate;

wherein each of the plurality of through-holes include a sidewall extending between the first surface and the opposing second surface; and wherein the sidewall of at least one of the plurality of through-holes has a non-linear profile.

12. The backplate of claim 11, wherein the sidewall of at least one of the plurality of through-holes has a notched profile.

13. The backplate of claim 11, wherein the sidewall of at least one of the plurality of through-holes has a stepped profile.

14. The backplate of claim 11, wherein the sidewall of at least one of the plurality of through-holes has a linearly sloped profile.

15. A microelectromechanical systems (MEMS) device, comprising:

a diaphragm; and a backplate spaced a distance from the diaphragm forming an air gap therebetween, the backplate including:

a first surface facing toward the diaphragm, the first surface having a first plurality of apertures that define a first perforation ratio of the first surface; and an opposing second surface facing away from the diaphragm, the opposing second surface having a second plurality of apertures that define a second perforation ratio of the opposing second surface;

wherein the first perforation ratio of the first surface is less than the second perforation ratio of the opposing second surface;

wherein the first plurality of apertures and the second plurality of apertures are positioned to align, thereby cooperatively forming a plurality of through-holes that extend through the backplate;

wherein each of the plurality of through-holes include a sidewall extending between the first surface and the opposing second surface; and wherein the sidewall of at least one of the plurality of through-holes has a non-linear profile.

* * * * *